US010507944B2

(12) United States Patent
Eckermann et al.

(10) Patent No.: US 10,507,944 B2
(45) Date of Patent: Dec. 17, 2019

(54) MACHINE AND METHOD FOR FOLDING AND ADHESIVELY BONDING BLANKS FOR THE PRODUCTION OF FOLDING BOXES

(71) Applicant: Jens Eckermann, Bremen (DE)

(72) Inventors: Jens Eckermann, Bremen (DE); Walter Bischoff, Oyten (DE)

(73) Assignee: Krones AG, Neutraubling (DE)

( * ) Notice: Subject to any disclaimer, the term of this patent is extended or adjusted under 35 U.S.C. 154(b) by 612 days.

(21) Appl. No.: 15/024,760

(22) PCT Filed: Sep. 26, 2014

(86) PCT No.: PCT/EP2014/070685
§ 371 (c)(1),
(2) Date: Apr. 26, 2016

(87) PCT Pub. No.: WO2015/044382
PCT Pub. Date: Apr. 2, 2015

(65) Prior Publication Data

US 2017/0157880 A1 Jun. 8, 2017

(30) Foreign Application Priority Data

Sep. 27, 2013 (DE) ..... 20 2013 104 432 U

(51) Int. Cl.
*B65B 43/10* (2006.01)
*B65B 7/16* (2006.01)
(Continued)

(52) U.S. Cl.
CPC ..... *B65B 43/10* (2013.01); *B31B 50/00* (2017.08); *B31B 50/02* (2017.08); *B31B 50/62* (2017.08);
(Continued)

(58) Field of Classification Search
CPC ..... B65B 5/024; B65B 43/10; B65B 43/126; B65B 43/145; B65B 43/185; B65B 43/42;
(Continued)

(56) References Cited

U.S. PATENT DOCUMENTS 2,251,671 A * 8/1941 Forst et al. ..... B65B 49/14 53/209
2,425,210 A * 8/1947 Stokes ..... B31B 50/00 198/346
(Continued)

FOREIGN PATENT DOCUMENTS

CN 201825574 U 5/2011
DE 1095193 B * 12/1960 ..... B65B 49/14
(Continued)

*Primary Examiner* — Stephen F. Gerrity
(74) *Attorney, Agent, or Firm* — Vidas Arrett & Steinkraus P.A.

(57) ABSTRACT

A machine for folding and adhesively bonding blanks for the production of folding boxes. It includes a transport system which has at least one puller which wraps around deflecting rollers and extends along a processing path, a drive connected to a deflecting roller and drives the deflecting roller. Workpiece carriers are fastened to the puller and are moved along the processing path by the at least one puller. It also includes a magazine for a stack of blanks, a mechanism for removing individual blanks from the stack in the magazine, a feeding mechanism for the removed blanks to the workpiece carriers, structure for retaining blanks on the workpiece carriers, a control which is connected to the structure to retain blanks, and structure for adhesively bonding blanks.

39 Claims, 18 Drawing Sheets

(51) Int. Cl.

| | |
|---|---|
| ***B65B 43/42*** | (2006.01) |
| ***B31B 50/00*** | (2017.01) |
| ***B31B 50/02*** | (2017.01) |
| ***B31B 50/62*** | (2017.01) |
| ***B31B 50/06*** | (2017.01) |
| ***B31B 50/36*** | (2017.01) |
| ***B31B 50/54*** | (2017.01) |
| ***B31B 50/07*** | (2017.01) |
| *B31B 100/00* | (2017.01) |
| *B31B 110/35* | (2017.01) |

(52) U.S. Cl.
CPC ..... *B65B 7/16* (2013.01); *B65B 43/42* (2013.01); *B31B 50/005* (2017.08); *B31B 50/006* (2017.08); *B31B 50/022* (2017.08); *B31B 50/06* (2017.08); *B31B 50/07* (2017.08); *B31B 50/36* (2017.08); *B31B 50/54* (2017.08); *B31B 50/624* (2017.08); *B31B 2100/00* (2017.08); *B31B 2100/0024* (2017.08); *B31B 2110/35* (2017.08); *B31B 2241/001* (2013.01)

(58) Field of Classification Search
CPC ..... B65B 49/14; B31B 50/005; B31B 50/02; B31B 50/022; B31B 50/042; B31B 50/06; B31B 50/07; B31B 50/26; B31B 50/52; B31B 50/54; B31B 50/62; B31B 50/624; B31B 50/36
USPC ..... 53/456, 383.1, 377.4, 378.3; 493/162, 493/177, 178, 179, 180, 182, 416, 418, 493/422, 446, 455
See application file for complete search history.

(56) References Cited

U.S. PATENT DOCUMENTS

| | | | | | |
|---|---|---|---|---|---|
| 2,521,577 | A | * | 9/1950 | Gannon | B65B 49/14 493/416 |
| 4,045,942 | A | * | 9/1977 | Muller | B65B 49/14 53/48.8 |
| 4,544,368 | A | * | 10/1985 | Labombarde | B31B 50/00 493/183 |
| 4,727,708 | A | * | 3/1988 | Conforto et al. | B65B 5/024 53/209 |
| 4,730,443 | A | * | 3/1988 | Matsuda et al. | B65B 49/14 53/207 |
| 4,982,551 | A | * | 1/1991 | Nigrelli, Sr. | B65B 5/06 53/251 |

FOREIGN PATENT DOCUMENTS

| | | |
|---|---|---|
| EP | 1 593 485 | 11/2005 |
| EP | 2 163 376 | 3/2010 |

* cited by examiner

Fig. 9.1
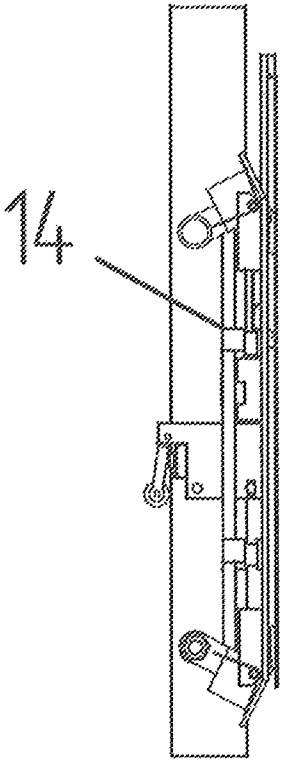

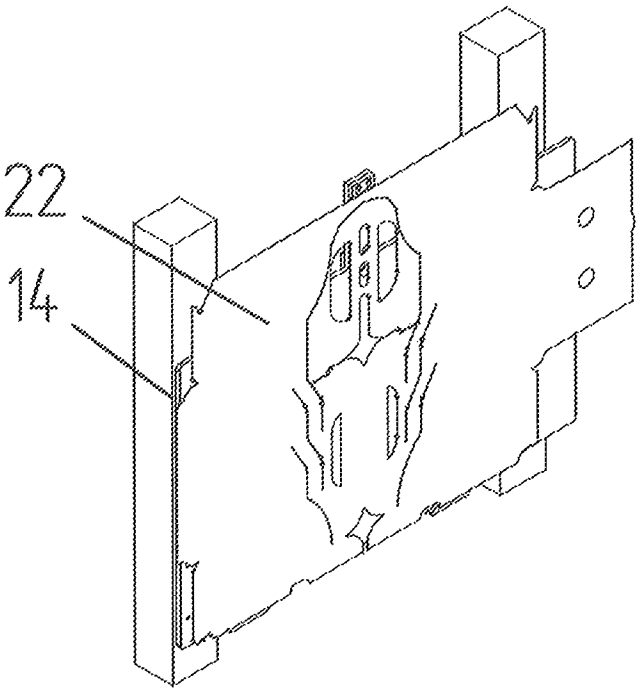
Fig. 9.2

Fig. 10.1
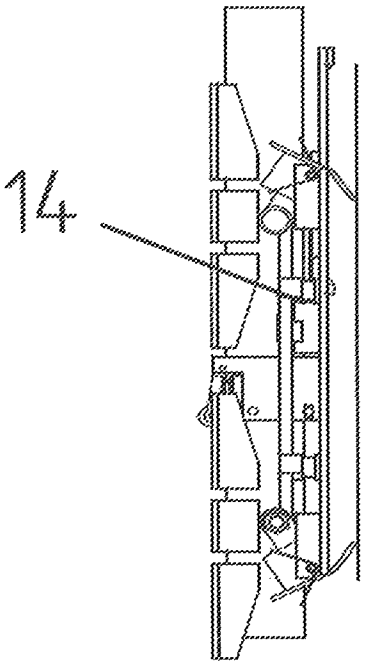

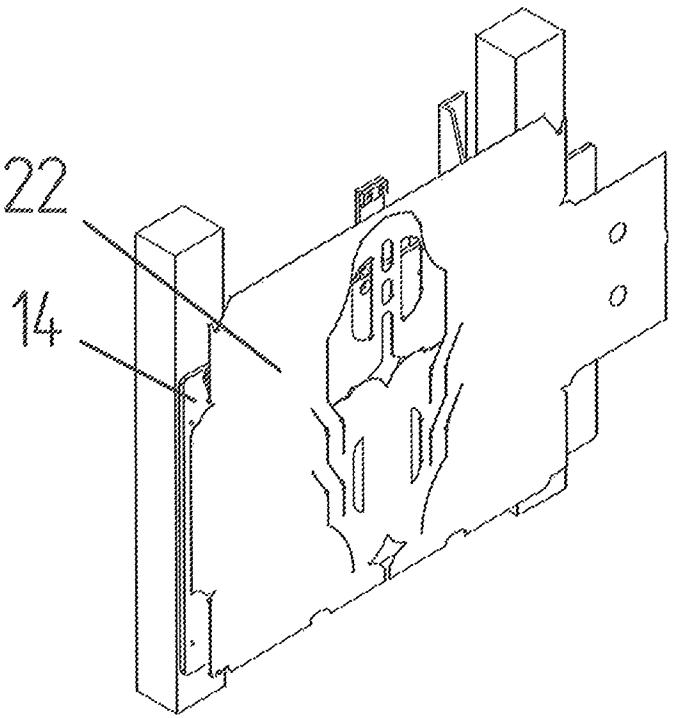
Fig. 10.2

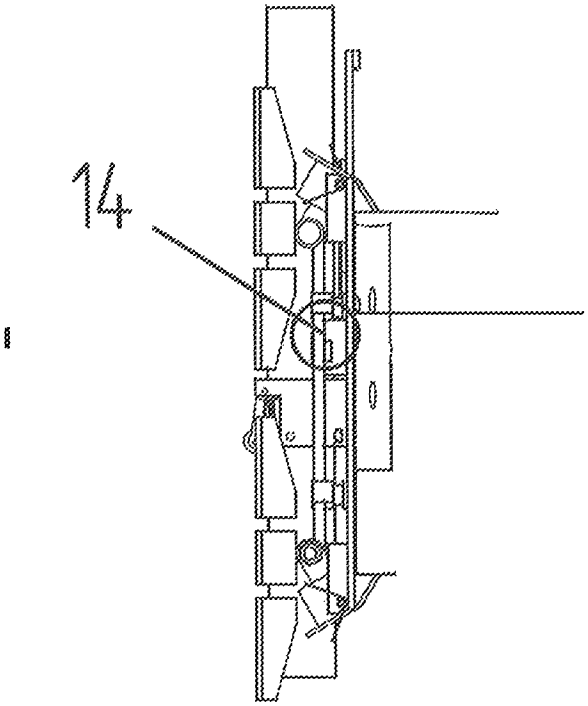
Fig. 11.1

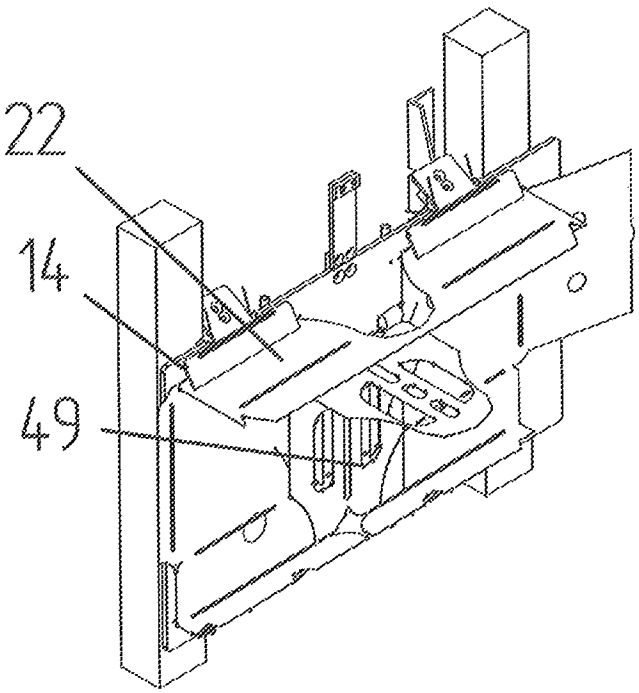
Fig. 11.2

Fig. 12.1
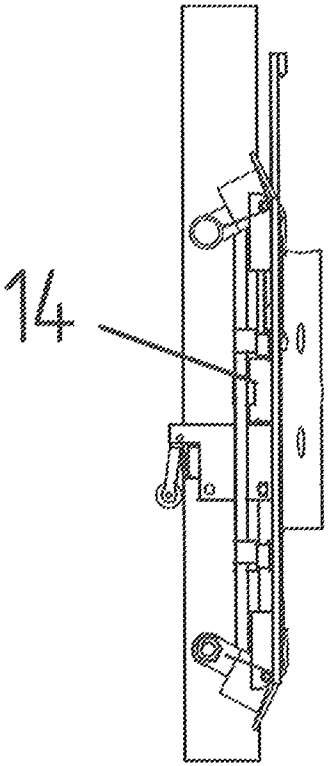

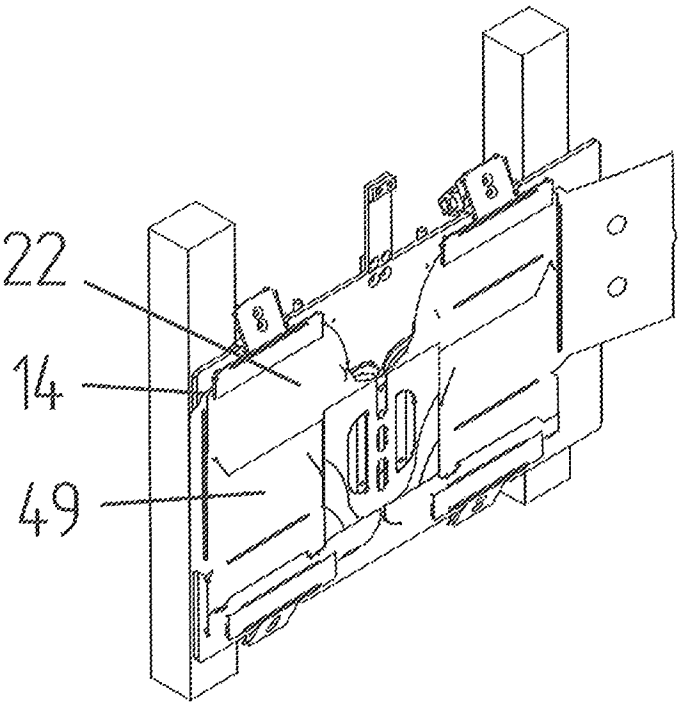
Fig. 12.2

Fig. 13.1
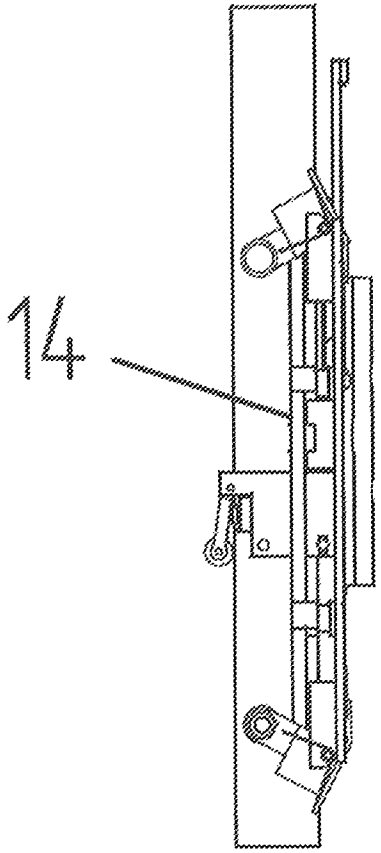

Fig. 13.2
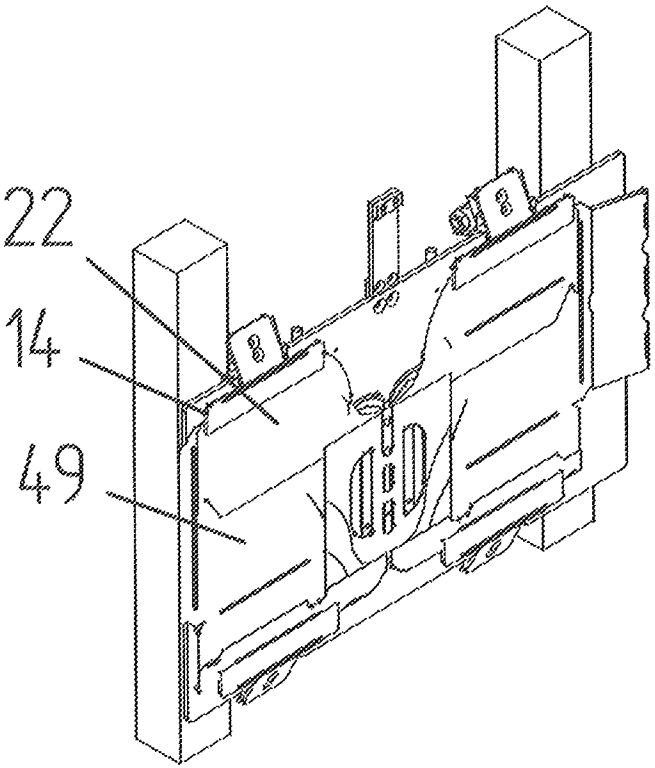

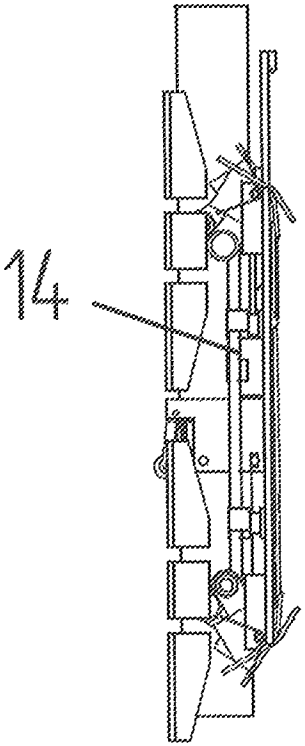
Fig. 14.1

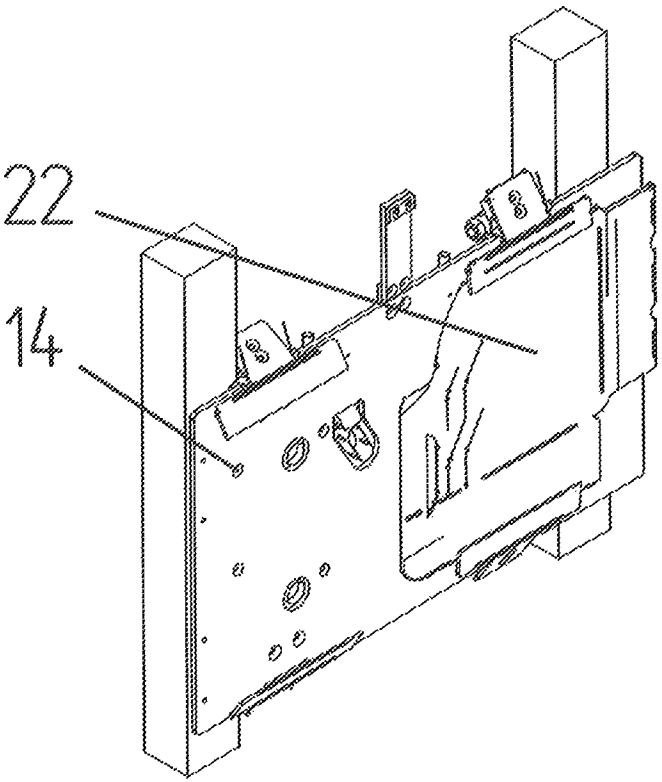
Fig 14.2

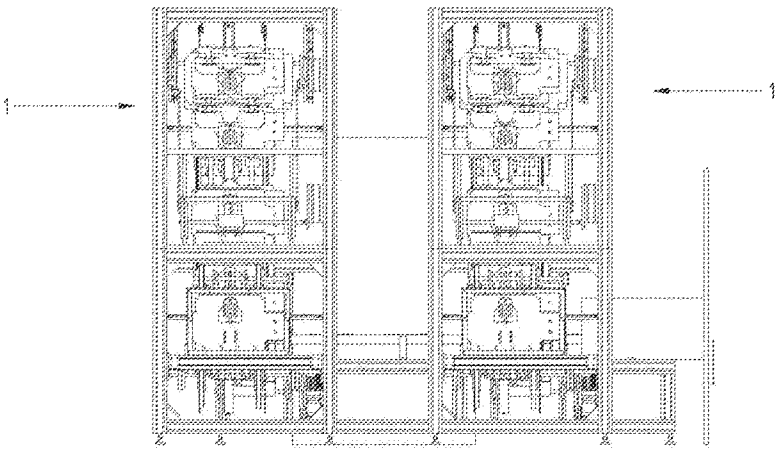
Fig. 15.2
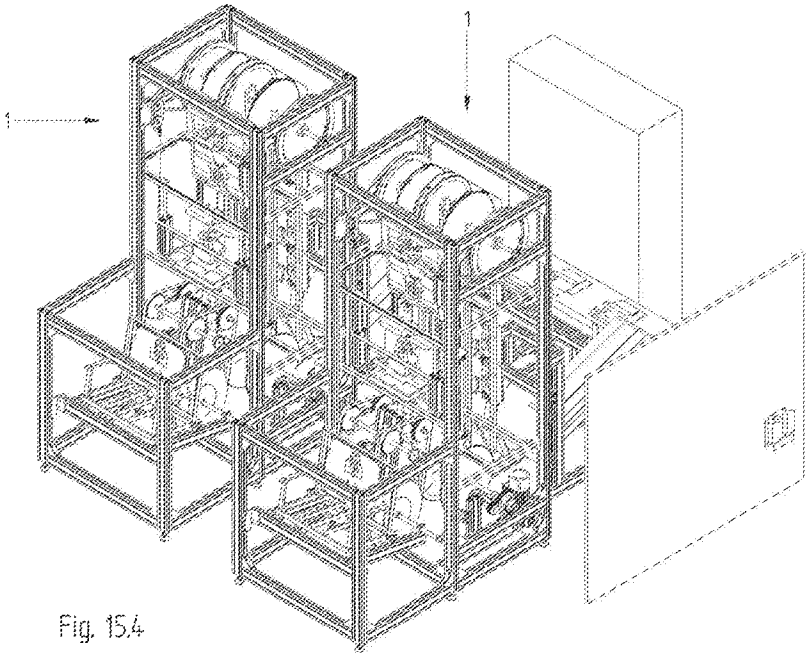
Fig. 15.4
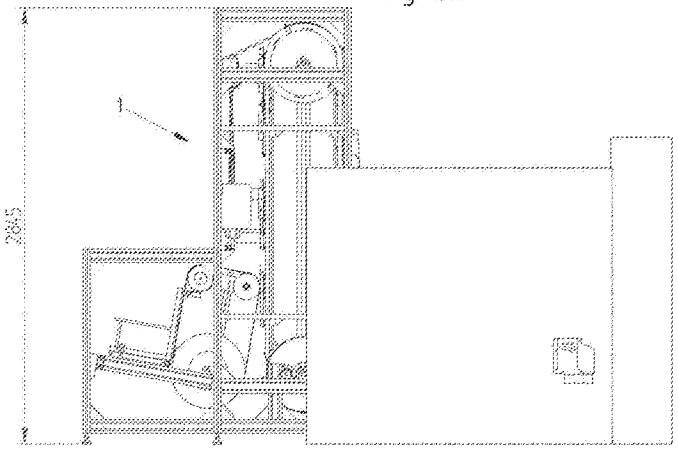
Fig. 15.1
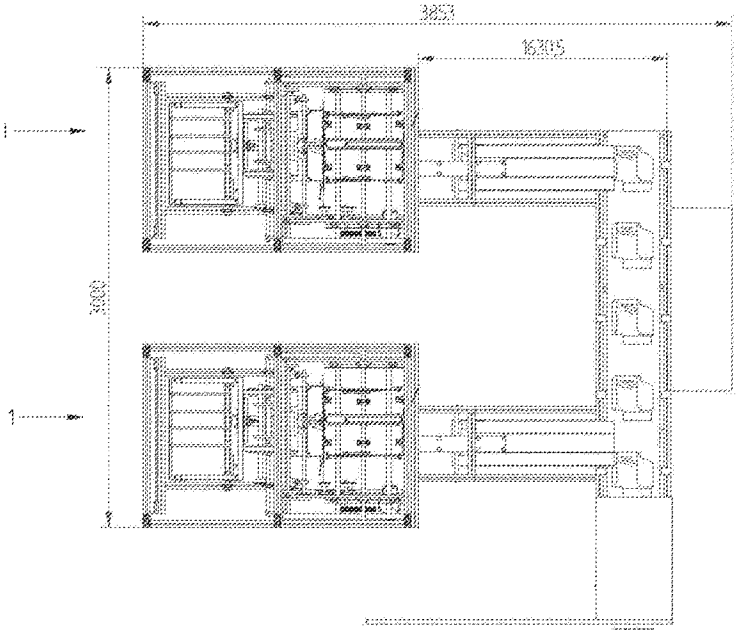
Fig. 15.3

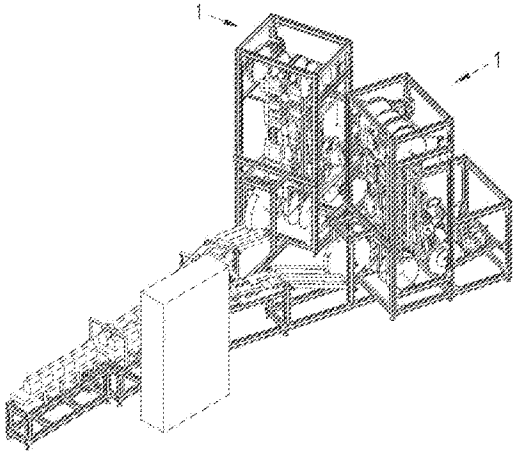
Fig. 16.3
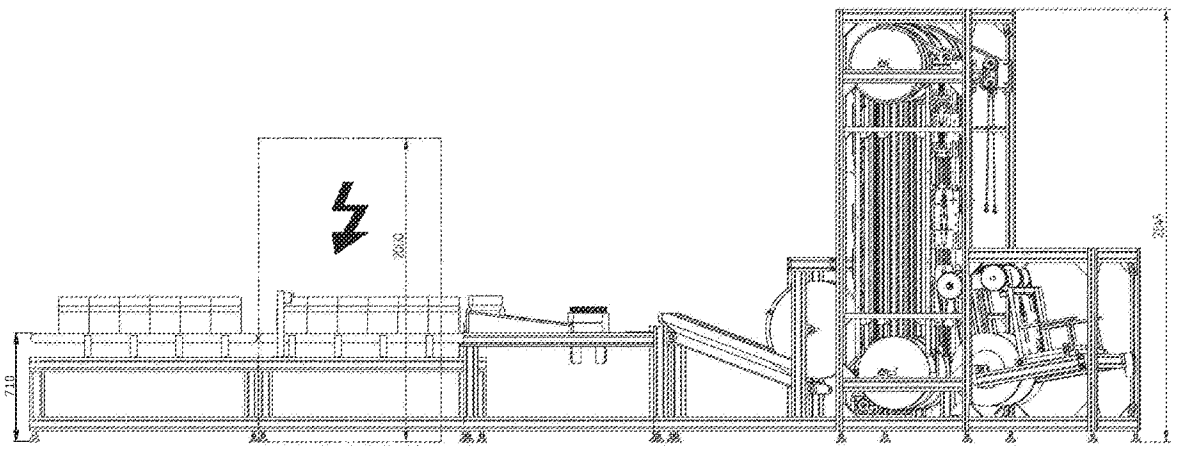
Fig. 16.1
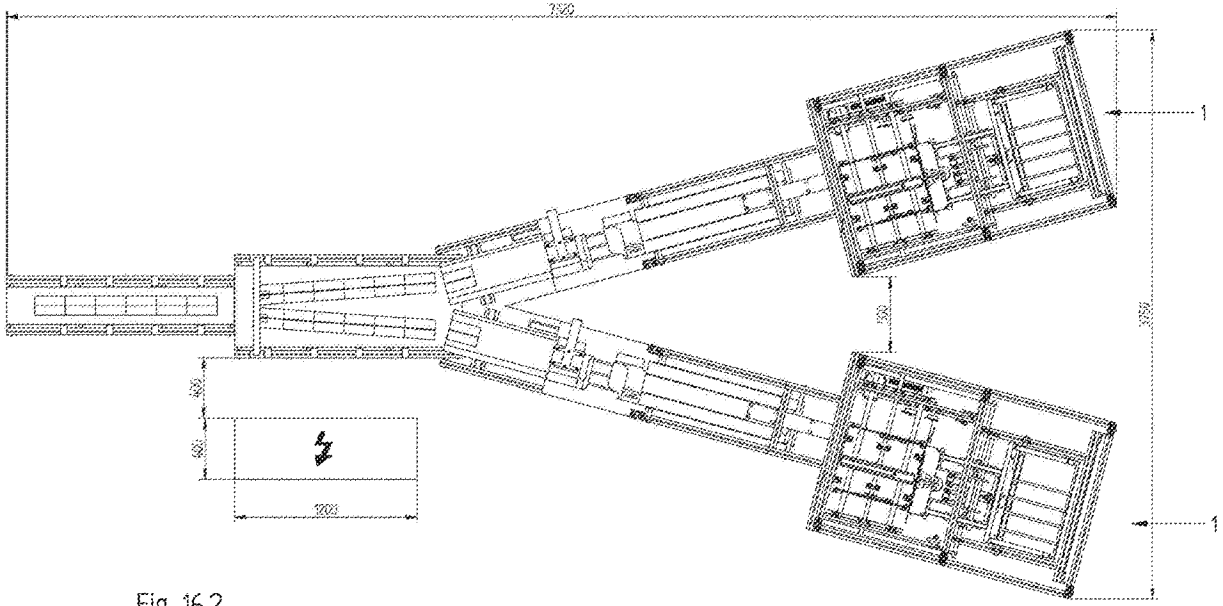
Fig. 16.2

MACHINE AND METHOD FOR FOLDING AND ADHESIVELY BONDING BLANKS FOR THE PRODUCTION OF FOLDING BOXES

BACKGROUND OF THE INVENTION

Field of the Invention

The invention relates to a machine and a method for folding and adhesively bonding blanks for the production of folding boxes.

Folding boxes are formed from one or more flat, stamped and pre-scored, or respectively slit blanks by folding, gluing and uprighting. Open basket carriers or OBC bottle carriers (basket-like bottle carriers) are particularly complex folding boxes which are produced from one or two blanks.

There are machines for folding and gluing such folding boxes which transport the blanks at a very rapid speed along fixed former bars which carry out the folds. In the process, the blanks are clamped between conveyor belts. With one machine type, blanks which have fold lines aligned at a right angle relative to each other are passed from a first processing line at which the first folds are carried out to a second processing line aligned 90° thereto at which the second folds are made. With another machine type, the blanks are rotated by 90° on the processing line. Additional blanks may be placed precisely on the blanks passing through when they pass along the processing line.

Misalignments, scrap and processing problems with a significant loss of material can easily occur in the known machines arising from the effect of fixed tools on the blanks traveling by. Given the high throughput speed, the processing lines are long, and the machines require a large floor-space. In addition, the investment costs for these machines are high. They are therefore only used by folding box manufacturers. The folded and glued blanks are packed into boxes, stacked on pallets and transported to the customer which aligns the blanks and fills them with goods. In the meantime, large quantities of the blanks are stored. This is associated with significant logistical effort.

Against this background, the objective of the invention is to provide an alternative machine and an alternative method for folding and gluing blanks for producing the folding boxes.

BRIEF SUMMARY OF THE INVENTION

The machine according to the invention for folding and adhesively bonding blanks for the production of folding boxes has:

- A transport system comprising at least one tractive means wrapped around deflection rollers and running along a processing line,
- a drive connected to at least one deflection roller and driving it,
- workpiece carriers that, at intervals from each other, are fastened to at least one tractive means and of which at least one tractive means is moved along the processing line,
- at least one magazine for a stack of blanks,
- at least one means for removing individual blanks from the stack in the magazine,
- at least one means for supplying the removed blanks to the workpiece carriers in a movement synchronized with the workpiece carriers along a section of the processing line,

- active means arranged on the workpiece carriers for holding blanks on the workpiece carriers, and/or
- active means arranged on the workpiece carriers for folding blanks on the workpiece carriers,
- control means which are connected to the active means for holding, and/or to the active means for folding, and are designed to control the holding and releasing of the blanks by the active means for holding, and/or to control the folding of the blanks by the active means for folding, and
- at least one means arranged fixedly on the processing line for gluing blanks, and/or means arranged on the workpiece carriers for gluing blanks.

The machine according to the invention has workpiece carriers which are moved along the processing line. The blanks are fed to the workpiece carriers, and the folding and gluing processes are carried out on the workpiece carriers. Since the blanks remain on the respective workpiece carriers without being transferred to other transportation systems during the folding and gluing process, a high degree of precision is achieved in the folding and gluing process. This is supported by the active means for holding arranged on the workpiece carriers that securely hold the blanks in specific positions on the workpiece carriers so that they do not slip during folding and gluing. Furthermore, this is supported by the active means for folding arranged on the workpiece carriers which execute the folding processes, wherein the forces exerted on the passing blanks by fixed folding means are avoided. Furthermore, the active means for folding can perform folds on fold lines aligned at a right angle to the direction of transportation of the workpiece carrier (transverse folds) which are impossible with fixed means for folding.

Preferably, the machine has both active means for holding as well as active means for folding which are each arranged on the workpiece carriers. The invention also relates to embodiments in which only active means for holding without active means for folding are arranged on the workpiece carriers. Such embodiments are for example suitable for uses in which the blanks can be folded solely by means of fixed means, or respectively means fixedly arranged on the processing line as, for example is the case with cuboid folding boxes which are only folded along fold lines aligned in the direction of transportation (longitudinal folds) and glued, and are filled by users through the front openings and closed. In this case, the means for folding which are fixedly arranged on the processing line are preferably passive means for folding. Furthermore, the invention relates to embodiments in which only active means for folding without active means for holding are arranged on the workpiece carriers. Such embodiments are for example suitable for uses in which transverse folds must be carried out, and static holding elements on the workpiece carriers are sufficient to hold the blanks in specific positions on the workpiece carriers. This is supported in that the active means for folding arranged on the workpiece carriers act with less force on the blanks while folding than fixed means for folding.

The active means for holding are means that hold the blanks on the workpiece carriers by means of a movable, non-solid or solid medium, such as by means of a gas, by applying an underpressure (vacuum) or overpressure (compressed air), and/or by means of a movable solid element.

The active means for folding are means that fold the blanks by means of a movable, non-solid or solid medium, such as by means of a gas, by applying an underpressure (vacuum) or overpressure (compressed air), and/or by means of a movable solid element. The active means for holding and the active means for folding can be partly or entirely the same means.

Passive means for folding are for example former bars arranged fixedly on the processing line, or other fixed tools. Passive means for holding are for example stop bars arranged on the workpiece carriers, and/or arbors for holding blanks.

The machine is suitable for folding and adhesively bonding blanks for the production of folding boxes of any kind. It is particularly suitable for folding and gluing simple blanks and complex blanks, such as blanks for cuboidal folding boxes and for OBC bottle carriers.

According to one embodiment version, the machine has at least one means for gluing blanks which is fixedly arranged on the processing line and is guided past the blanks on the workpiece carriers. This can be in particular linear, flat or other simple gluings. According to another embodiment version, means are arranged for gluing on the workpiece carriers. This can be advantageous for complex gluing geometries, and/or for performing a plurality of gluing processes on the same blanks.

A combination of both embodiment versions is also possible.

The control means are preferably mechanical control means, or pneumatic control means, or hydraulic control means, or electrical control means, or any combination of the aforementioned control means.

The machine according to the invention is particularly suitable for being used in production processes with small batch sizes due to its high processing reliability, its flexibility with regard to processing different blanks, and its comparatively minimum complexity, and in production processes in which orders with different blanks must be processed in quick succession. The machine can in particular be used by folding box manufacturers. The machine is also suitable for folding and gluing blanks for users who fill the blanks with goods. Transporting unfolded and unglued blanks from the folding box manufacturer to the user and storing these blanks at the user is significantly more economical than transporting and storing folded and glued blanks. After being folded and glued, the folded and glued blanks can either be temporarily stored at the user's, or the user supplies the folded and glued blanks in a continuous production process directly (in-line) to a packaging machine for filling the blanks with goods. For production processes with large batch sizes, a plurality of machines according to the invention can be used sequentially, such as at the folding box manufacturer's or at the user's.

According to one embodiment, a plurality of active means for holding, and a plurality of active means for folding, can be arranged on each workpiece carrier. This is advantageous for the folding and gluing process. According to another embodiment, the control means are designed to separately control each active means for holding, and/or each active means for folding, on each workpiece carrier. During folding, this makes it possible to control a part of the active means for holding so that it releases the part of the blank to be folded, and the rest of the blank is held with another part of the active means for holding so that it retains its position. Furthermore, it is possible to perform a plurality of different folding processes on each workpiece carrier.

According to another embodiment, the active means for holding are selected from the means: Vacuum cup, compressed air nozzle, folding flap, or any combination of a plurality of the aforementioned means.

According to another embodiment, the active means for folding are selected from the means: Folding flap, vacuum cup, compressed air nozzle, cam wheel, linear actuator, or any combination of a plurality of the aforementioned means.

According to another embodiment, the vacuum cups and/or the compressed air nozzles are connected to means for supplying a vacuum and/or compressed air from a fixedly arranged vacuum generator, and/or compressed air generator, to workpieces movable along the processing line. All the vacuum cups, and/or compressed air nozzles can be connected via the supplying means to the same vacuum generator, and/or the same compressed air source. Alternatively, a vacuum generator and/or a compressed air source are arranged on each workpiece carrier and can be driven by the movement of the workpiece carrier.

The vacuum generator is preferably a slide vane rotary vacuum pump, or a diaphragm pump, or another vacuum pump. The compressed air source is preferably a reciprocating compressor, or a screw-type compressor, or another compressor, or a compressed air network.

According to another embodiment, the means for supplying a vacuum, and/or the means for supplying compressed air, have a fixed air channel running parallel to the processing line and connected to the vacuum generator and/or the compressed air source and which, on one side, has an opening that extends along the processing line and is sealingly covered by a parallel belt which runs around at least one tractive means and has holes next to the workpiece carriers which are connected via lines to the vacuum cups and/or the compressed air nozzles on the workpiece carriers. A vacuum, or respectably compressed air, is provided along a processing line through the air channel. The air channel has an opening extending along the processing line. A belt runs parallel to the at least one tractive means, wherein it sealingly covers the opening in the air channel. The vacuum cups and/or the compressed air nozzles on the workpiece carriers are connected via lines to holes in the belt. The vacuum, or respectively compressed air, in the air channel passes through the lines to the vacuum cups, or respectively the compressed air nozzles on the workpiece carriers. The vacuum cups, or respectively compressed air nozzles, are thereby reliably supplied with a vacuum, or respectively compressed air, in an easy and reliable manner.

According to another embodiment, valve means are arranged on the workpiece carriers by means of which the vacuum cups are connected to the means for supplying a vacuum, and/or the compressed air nozzles are connected to the means for supplying compressed air, and the valve means are connected to the control means. By means of the valve means, the control means control the connection of the vacuum cups to the vacuum generator, and/or the compressor air nozzles to the compressed air source. The actuation of the means for holding, and/or the means for folding, is hence controlled by the valve means.

According to another embodiment, the active means for holding, and/or the active means for folding, comprise flaps arranged on the workpiece carriers for clamping and/or folding sections of the blanks, and it means for pivoting the flaps, and the means for pivoting are connected to the control means. By means of the flaps, sections of the blanks can be clamped between the flaps and a bearing surface of the workpiece carrier so that they are held on the workpiece carrier. Alternatively, sections of the blanks can be pivoted by means of the flaps relative to the bearing surface in order to fold these sections against other sections of the blanks which are held on the workpiece carriers.

According to another embodiment, the means for pivoting comprise spring elements that pretension the flaps into a starting position. The flaps can be swung out of the starting position by other means for pivoting. When the other means for pivoting do not act, the flaps are independently moved back into the starting position by the spring elements.

According to another embodiment, the control means have stationary curves, and the active means for holding, and/or the active means for folding are coupled to contacting means for contacting the curves. The contacting means are means for pivoting the flaps. Preferably, the flaps are additionally pretensioned by spring elements into a starting position. The spring elements can press the contacting means against the stationary curves so that the flaps are precisely controlled corresponding to the contour of the stationary curves. Alternatively, the contacting means are guided along the stationary curves which move the contacting means in different directions in order to pivot the flaps back and forth. To this end, a pin of the contacting means for example engages in a groove, the sides of which form the curves.

According to one embodiment, the machine has passive means for holding blanks arranged on the workpiece carriers, and/or at least one passive means fixedly arranged on the processing line for folding blanks on the workpiece carriers.

According to another embodiment, the workpiece carriers have stop bars and/or arbors for holding the blanks. The passive means for holding blanks can be present in addition to or instead of active means for holding blanks. According to another embodiment, the passive means for folding is a former bar arranged on a processing line (also termed a "deflector" or "folding switchpoint") which is contacted by the blanks held on the workpieces while passing through the processing line. The passive means for folding can be present in addition to or instead of active means for folding.

Another embodiment has active means arranged on the workpiece carriers for folding the blanks along fold lines in a direction perpendicular to the direction of transport, and/or passive means fixedly arranged on the processing line for folding blanks along fold lines in the direction of transport of the workpiece carriers. Preferably, the folds are carried out in a direction perpendicular to the direction of transport by active means for folding. The folds along fold lines in the direction of transport of the workpiece carriers can also be carried out by active means for folding.

It is also always possible to perform the folds along fold lines in the direction perpendicular to the direction of transport by passive means for folding. To this end according to one embodiment, the workpiece carriers are pivotably mounted on a base and are fastened to at least one tractive means. The pivotable workpiece carriers are connected to a drive which is connected to the control means that are designed to control the pivoting of the workpiece carriers into one or the other pivot position. The pivoting movements of the workpiece carriers on the base can for example be controlled by means of curves. When transporting the workpiece carrier along first passive means, the workpiece carrier is in a first pivot position in which the first passive means execute folds on the fold lines running in the direction of transport. Then the workpiece carrier is pivoted 90° into the second pivot position. In the second pivot position, the workpiece carrier passes by second passive means which perform the folds of the blanks on the fold lines running in the direction of transport. Then the workpiece carrier is pivoted back into the first pivot position. In this manner, it is possible to have the passive means fold in the blanks along at least two fold lines oriented at a right angle to each other.

According to one embodiment, at least one pressure roller is fixedly arranged on the processing line and rolls on the folded blanks on the workpiece carriers. By means of the pressure roller, the material is pressed together along the fold lines in order to break the cardboard fibers and complete the folds.

According to another embodiment, the runs of the at least one tractive means are oriented vertically. The processing line can therefore extend over both runs. This enables a particularly space-saving machine design.

According to another embodiment, the components of the machine are arranged in a frame. This makes it easier to install and remove the components, in particular while servicing and converting in order to prepare the machine for processing different blanks. According to one embodiment, the machine has an elongated, vertical frame. This is advantageous for a space-saving machine setup.

According to another embodiment, the at least one magazine and the means for supplying individual blanks are arranged on the side of one run of the tractive means, and the delivery station for delivering folded and glued blanks is arranged on the side of the other run of the tractive means. This embodiment is space-saving and makes it easier to integrate the machine into the processing procedure at the folded box manufacturer's or customer's.

According to another embodiment, the means for removing individual blanks from the stack in the magazine comprises a vacuum system which is designed to draw an individual blank from a stack in the magazine into a transfer position.

According to another embodiment, the means for supplying the removed blanks to one of the workpiece carriers comprises an additional transportation system with at least one additional tractive means running around deflection rollers, wherein another run of the additional tractive means runs by the transfer position, and another run of the additional tractive means runs along a section of the transfer line, drivers are arranged on the additional tractive means, the additional transport system has an additional drive, the vacuum system and the additional drive are connected to the control means which is designed such that the vacuum system is synchronized with the additional drive, and the additional drive is synchronized with the drive such that the vacuum system always positions an individual blank from the magazine in the transfer position between the drivers on the additional tractive means, the at least one additional tractive means entrains the blank held between the drivers, and the blank is supplied to the workpiece carrier via the run extending substantially in the direction of a section of the processing line. The blanks provided by the means for removing in the transfer position are accelerated by the additional transportation system to the speed of the workpiece carriers and supplied thereto. A flawless transfer of the blanks to the workpiece carriers can thereby be achieved.

This embodiment is suitable in particular for supplying blanks for OBC bottle carriers to the workpiece carriers, in particular for supplying a jacket blank for such a bottle carrier.

According to one embodiment, the means for removing individual blanks from the stack in the magazine comprises a pivoting suction unit which always places an individual blank on a delivery table. According to an additional embodiment, the means for supplying the removed blank to one of the workpiece carriers comprises a carriage which is guided in guides along a section of the processing line, and on which an additional pivoting suction unit is arranged which is designed to receive an individual blank from the delivery table when the carriage is arranged in a bottom position and, after a pivoting movement, to supply the blank to a workpiece carrier in a top position of the carriage, wherein the carriage is connected to another drive, the pivoting suction unit is connected to an additional drive, and the additional pivoting suction unit is connected to an additional drive, and the additional drives are connected to the control means which are designed such that, after a blank is placed on the delivery table by the pivoting suction unit, the additional pivoting suction unit receives the blank, and the carriage executes a synchronized movement with one of the workpiece carriers, and the additional pivoting suction unit thereby supplies the blank to the workpiece carrier. A particularly dependable supply of blanks to the workpiece carrier is thereby achieved.

The embodiment is particularly advantageous for supplying an additional blank to the workpiece carrier on which a blank has already been placed. This embodiment is particularly advantageous for supplying blanks to form a middle wall and a grip reenforcement in OBC bottle carriers.

According to another embodiment, the means for supplying have a supply plate on which each blank can be positioned, and the means for supplying have means for transferring the supply plate at a right angle to the run of the transport system by a middle drive that is connected to the control means, and the control means are designed to control the transfer of the supply plate at a right angle toward the workpiece carrier in the last section of supplying each blank to one of the workpiece carriers in order to supply the blank by means of the supply plate to the workpiece carrier. This further improves process reliability.

According to another embodiment, the supply plate is dimensioned such that, when moving at a right angle toward the workpiece carrier, it can move between support means on the workpiece carrier on which a blank can be placed. A folding process can be thereby initiated. The support means on the workpiece carrier can in particular be flaps which are in a starting position.

According to another embodiment, the additional pivoting suction unit comprises means for transferring the blank at a right angle toward the workpiece carrier by an additional drive that is connected to the control means. This further improves process reliability.

According to one embodiment, the control means are designed such that the active means for holding on the workpiece carriers take the blanks from the at least one means for supplying. This further improves process reliability. In particular, vacuum cup on the workpiece carriers can be controlled such that they suction the blanks while supplying.

According to another embodiment, the machine comprises means for uprighting the folded and glued blanks into folding boxes. The uprighted folding boxes can then be directly filled with goods. This embodiment is particularly suitable for use by the user.

Another embodiment relates to the arrangement of a machine according to the invention in front of a machine for combining folded and glued blanks into transport units, or in front of a machine for filling the folded, glued and uprighted blanks with goods. The transport units are for example stacks of folded, glued blanks, or a plurality of such stacks on a pallet.

In the method according to the invention for folding and adhesively bonding blanks for the production of folding boxes:

The blanks are held on workpiece carriers by active means for holding blanks, and are transported together with the workpiece carriers along a processing line while being folded, and/or together with the active means for folding, the blanks are transported on workpiece carriers along a processing line and are folded by the active means for folding while being transported along the processing line, and while being transported along the processing line, the blanks are glued by at least one means for gluing blanks fixedly arranged on the processing line, and/or are glued by means for gluing blanks transported on the workpiece carriers along the processing line with the blanks.

According to another embodiment, the blanks are pulled off of a stationary stack on the processing line and supplied to the workpiece carriers.

According to another embodiment, each active means for holding, and/or each active means for folding, are controlled separately.

According to another embodiment of the method, the active means for holding securely hold the blanks to the workpiece carriers by means of a vacuum or compressed air, or by clamping, or any combination of a plurality of the aforementioned measures, and/or the active means for folding fold the blanks by means of folding flaps, a vacuum, compressed air, a cam wheel, linear actuator or any combination of a plurality of the aforementioned measures.

According to another embodiment, the vacuum and/or the compressed air is supplied to the active means for holding, and/or the active means for folding, on the workpiece carriers, by a stationary vacuum generator and/or a stationary compressed air source while transporting along the processing line.

According to another embodiment, the active means for holding, and/or each active means for folding, are controlled by contacting stationary curves.

According to another embodiment of the method, while being transported along the processing line, the blanks are held by passive means for holding on the workpiece carriers transported along the processing line, and/or are folded by at least one passive means for folding fixedly arranged on the processing line.

According to another embodiment of the method, active means for folding which are transported along the processing line fold the blanks while being transported along the processing line along fold lines in the direction perpendicular to the direction of transport, and/or passive means for folding which are fixedly arranged on the processing line fold the blanks along fold lines in the direction of transport.

According to another embodiment of the method, the blanks are rotated 90° while being transported along the processing line and are folded by means for folding arranged along the processing line on fold lines offset from each other by 90°.

According to another embodiment of the method, after a fold on a fold line, the blanks are further processed along the fold line by means of a pressure roller that rolls on the blanks and is stationarily arranged on the processing line.

According to another embodiment of the method, the blanks are transported, folded and glued along a vertically oriented processing line.

According to another embodiment of the method, the blanks are first transported upward and then downward after being supplied to the processing line, and are removed from the processing line while being transported downward.

According to another embodiment of the method, the blanks are removed from a magazine by suction and supplied to the processing line.

According to another embodiment of the method, the blanks are uprighted, filled and closed following the processing line.

According to another embodiment of the method, the blanks are stacked in a flat state following the processing line.

According to another embodiment of the method, the blanks are temporarily stored following the processing line, or are uprighted, filled and closed directly after the processing line.

BRIEF DESCRIPTION OF THE SEVERAL VIEWS OF THE DRAWING(S)

The invention is explained in greater detail below based on the appended drawings of an exemplary embodiment. In the drawings.

FIG. 9.1 shows a workpiece carrier of the machine with a jacket blank for an open basket carrier in a view from the left side;

FIG. 9.2 shows the workpiece carrier of FIG. 9.1 in a perspective view from the left side and from the front;

FIG. 10.1 shows the workpiece carrier with the jacket blank at a higher position on the processing line in a side view from the left side;

FIG. 10.2 shows the workpiece carrier of 10.1 in a perspective view from the left side and from the front;

FIG. 11.1 shows the workpiece carrier with the jacket blank and a middle wall blank that are each partially folded transversely in a side view from the left side;

FIG. 11.2 shows the workpiece carrier of 11.1 in a perspective view from the left side and from the front;

FIG. 12.1 shows the workpiece carrier with the jacket blank and the middle wall blank after the transverse folds in a view from the left side;

FIG. 12.2 shows the workpiece carrier of 12.1 in a perspective view from the left side and from the front;

FIG. 13.1 shows the workpiece carrier with the jacket blank and the middle wall blank after the longitudinally folding the floor in a view from the left side;

FIG. 13.2 shows the workpiece carrier of FIG. 13.1 in a perspective view from the left side and from the front;

FIG. 14.1 shows the workpiece carrier with the uprighted jacket blank and the middle wall blank after a final longitudinal fold in a view from the left side;

FIG. 14.2 show the workpiece carrier of FIG. 14.1 in a perspective view from the left side and from the front;

FIG. 15.1 shows a combination of two machines according to the invention with a conveyor belt for folded and glued bottle carriers in a view from the right side;

FIG. 15.2 shows FIG. 15.1 from the front;

FIG. 15.3 shows FIG. 15.1 from the top;

FIG. 15.4 shows FIG. 15.1 from a perspective view from the front and from the right side;

FIG. 16.1 shows a combination of two machines according to the invention, each having an erector in a view from the left side (FIG. 16.1);

FIG. 16.2 shows FIG. 16.1 in a top view;

FIG. 16.3 shows FIG. 16.1 in a perspective view from the left side and from the rear.

DETAILED DESCRIPTION OF THE INVENTION

Figure 2:
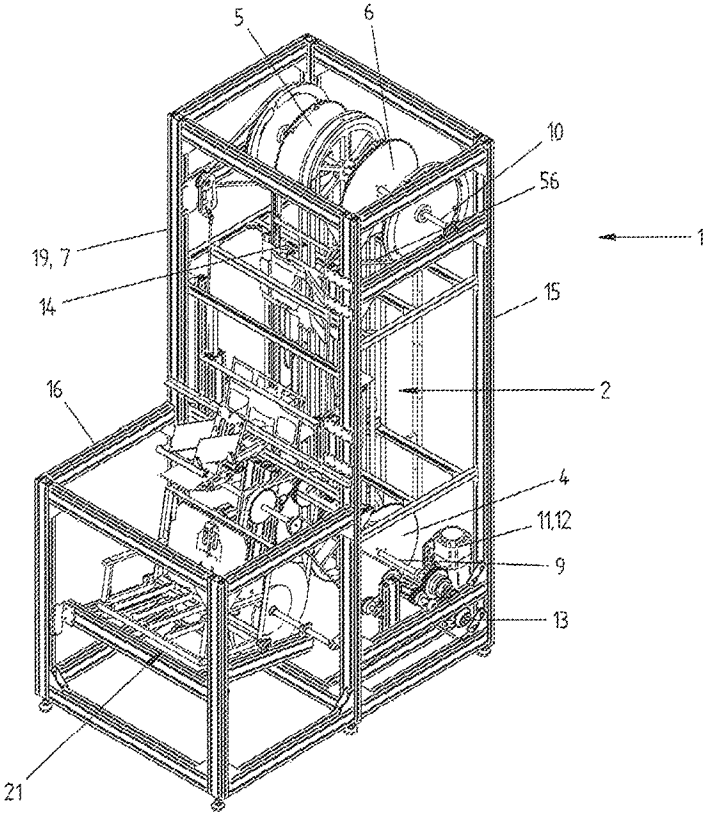
FIG. 2 shows the machine in a perspective view from above and from the right side.
Figure 1:
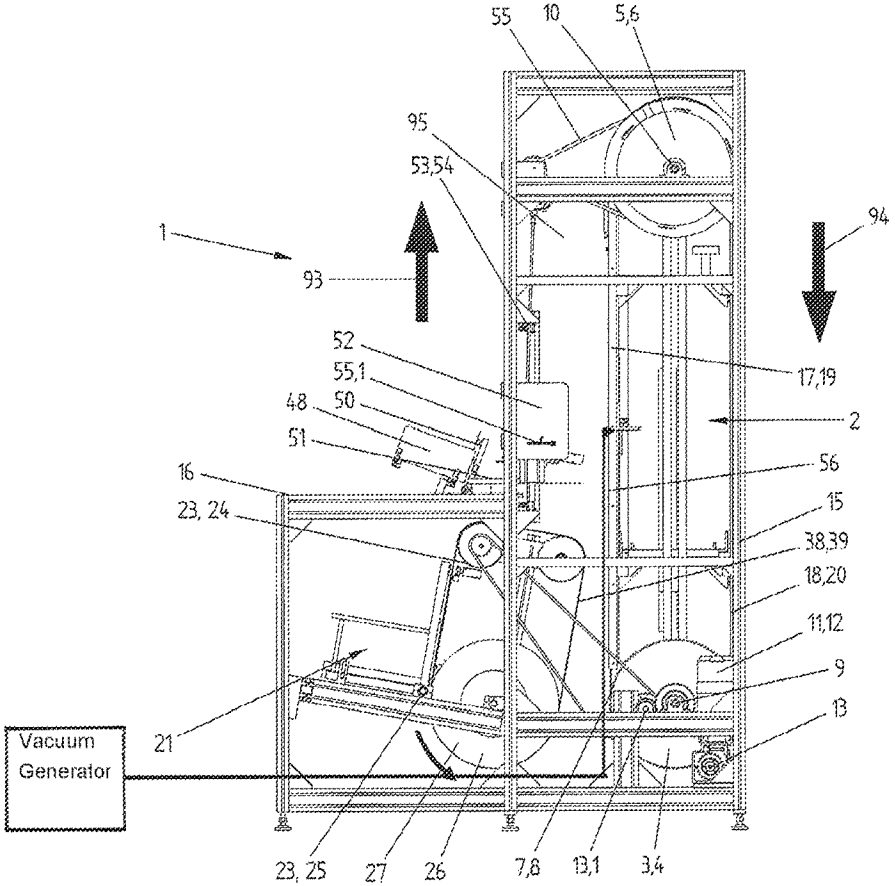
FIG. 1 shows the machine in a side view from the right side.
Figure 3:
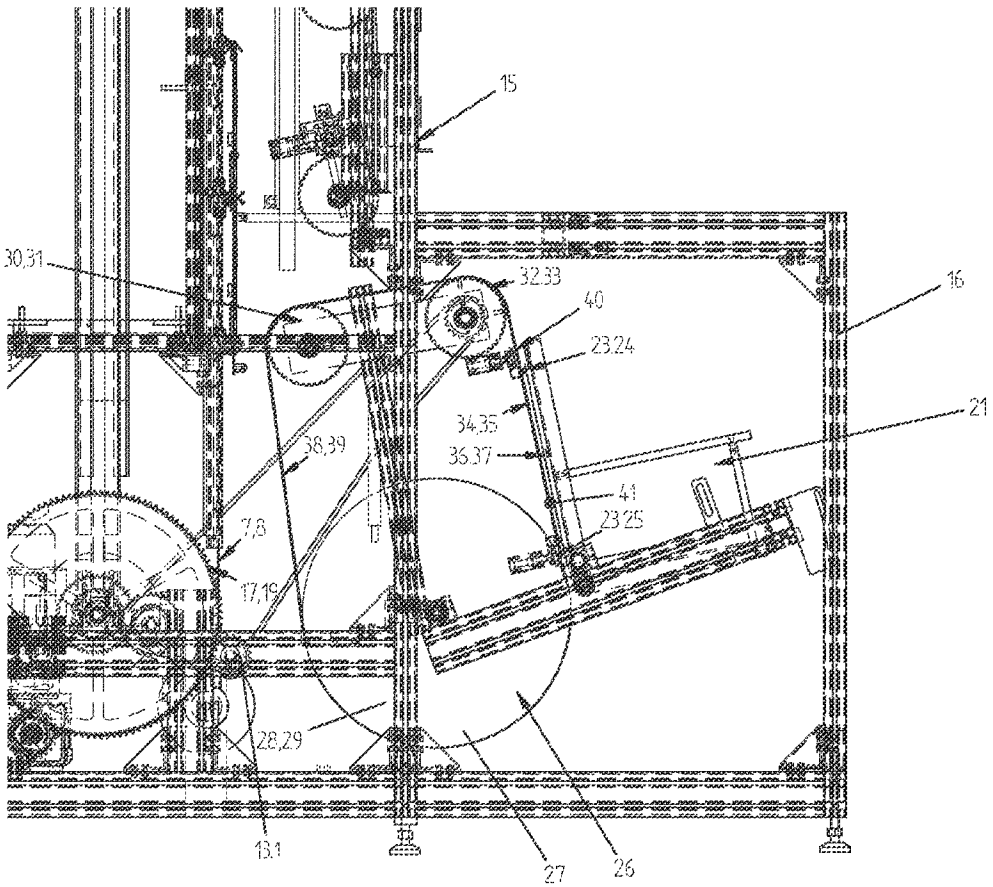
FIG. 3 shows an enlarged detailed view from the left side of means for removing and supplying blanks to and from the machine.

According to FIGS. 1 and 2, a machine 1 according to the invention comprises a transport system 2 having two parallel, bottom deflection rollers 3, 4 and top defection rollers 5, 6, at a distance from each other by means of which a tractive means 7, 8 is guided. The deflection rollers 3 to 5 are sprocket wheels, and the tractive means 7, 8 are chains.

The deflection rollers 3 to 5 are each mounted on shafts 9, 10.

A drive which comprises an electric motor 12 and a gearbox 13 drives the bottom shaft 9 on which the two bottom deflection rollers 3, 4 sit.

Workpiece carriers 14 are fastened to the two tractive means 7, 8 at distances from each other. To this end, the tractive means 7, 8 are each securely connected to base parts on which the workpiece carriers 14 are mounted. The base parts are for example crossmembers securely connected to both tractive means 7, 8. The workpiece carriers 14 are removable from the base parts and exchangeable with other workpiece carriers 14 in order to adapt the machine 1 to the blanks to be processed.

The individual parts of the machine 1 are arranged in an elongated, vertical frame 15. Arranged on the front side of the frame is another frame 16 that is connected to the frame 15, yet possesses a lower height than that frame.

The two runs 17, 18, 19, 20 of each tractive means 7, 8 are oriented vertically.

A bottom magazine 21 is mounted in the other frame 16. A stack of blanks 22 (such as jacket sections of an OBC) are stored thereupon at an angle so that the bottom blank 22 in the stack is closest to the transport system 2.

A vacuum system 23 comprising a plurality of vacuum cups 24, 25 is assigned to the bottom magazine 21. These are able to pull off individual blanks 22 from the bottom end of the bottom magazine 21.

Furthermore, the machine 1 comprises means for supplying 26 the blanks 22 removed from the bottom magazine 21 to the workpiece carriers 14. These comprise an additional transport system 27 that has two tractive means 34, 35 which are each guided around three additional deflection rollers 28 to 33. One of the additional deflection rollers 28 to 33 is coupled by means of another gearbox 13.1 to the drive 11 of the transport system 2. The vacuum system 23 is capable of drawing individual blanks 22 out of the stack into a transfer position.

The additional tractive means 34, 35 each has an additional run 36, 37 that runs by the transfer position. Furthermore, they have an additional run 38, 39 which is guided along a section of the transfer line. The additional runs 38, 39 are angled at a sharp angle to the runs 17, 18, and approach the runs 17, 18 upward from below.

Drivers 40, 41 are arranged on the two additional tractive means 34, 35 at set intervals from each other. The distance between the drivers 40, 41 on the additional tractive means 34, 35 is such that just one blank 22 passes between the drivers 40, 41 and is clamped between them.

At the bottom, the additional tractive means 34, 35 are guided over additional deflection rollers 28, 29 with a large radius. At the top, the additional tractive means 34, 35 each run over two adjacently arranged additional deflection rollers 30 to 33 with a small radius.

Figure 8:
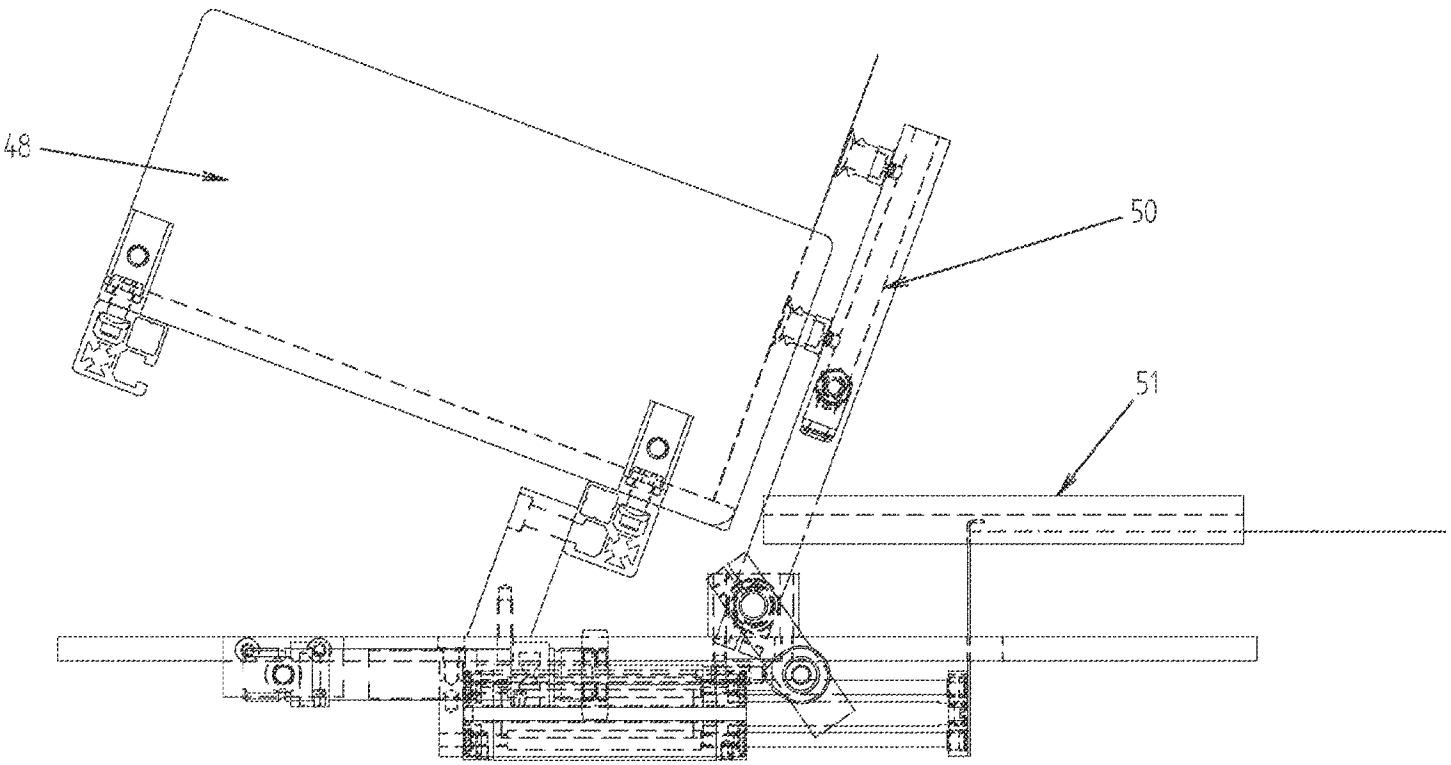
FIG. 8 shows additional enlarged detailed view from the right side of means for removing and supplying blanks to and from the machine.

Furthermore, a top magazine 48 is available for another stack with additional blanks 49 (see FIG. 8). The top magazine 48 is mounted in the top area of the additional frame 16. It is also angled relative to the horizontal so that the bottom-most blank in the stack is closest to the transport system 2. The additional blanks 49 are for example middle wall blanks of an OBC.

A pivoting suction unit 50 is arranged close to the bottom end of the top magazine 48. Located adjacent thereto is a delivery table 51 on which the pivoting suction unit 50 places individual, additional blanks 49 from the top magazine 48.

Arranged adjacent thereto is a carriage 52 which can be moved up and down along vertical guides 53, 54. An additional gearbox 55 is coupled to the top deflection rollers 5, 6 for moving the carriage 52 up and down.

Arranged on the carriage 52 is an additional pivoting suction unit 55.1 for picking up the individual, additional blanks 49 from the delivery table 51 and swinging them to the workpiece carriers 14 on the adjacent runs 17, 18 of the transport system 2.

Figure 6:
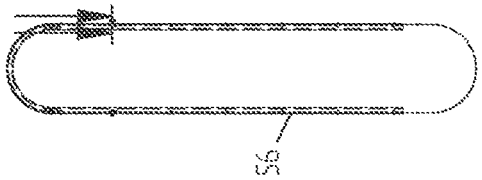
FIG. 6 shows a side view of means for supplying a vacuum to the machine.
Figure 7:
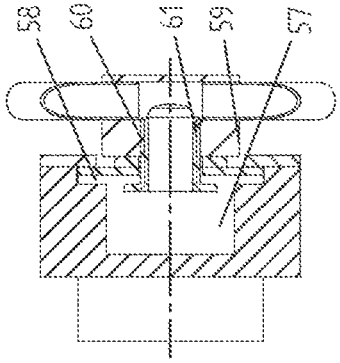
FIG. 7 shows a horizontal section of the same means.

In the frame 15, means are available for supplying 56 a vacuum and extend parallel to the tractive means 7, 8 of the transport system 2. The means for supplying 56 a vacuum comprises a fixed air channel 57 that is arranged between the two tractive means 7, 8 and runs parallel thereto (see FIG. 6, 7). On the outside facing the workpiece carriers 14, the air channel 57 has an opening 58 extending along the processing line. The opening 58 is sealed by an endless belt 59 which also circulates with the tractive means 7, 8. Adjacent to the workpiece carriers, the belt 59 has holes 60 which are connected via lines 61, preferably in the form of hoses, to vacuum cups 62, 63, 64, 65 on the workpiece carriers 14.

The air channel 57 is connected to a vacuum pump.

Figure 4:
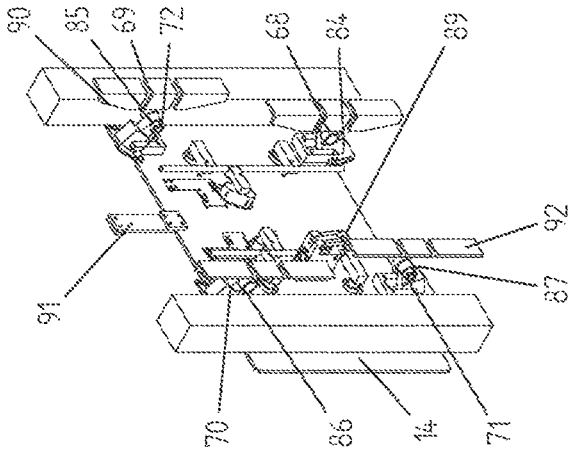
FIG. 4 shows a workpiece carrier of the machine according to the invention in a perspective view from the rear.

The workpiece carriers 14 each have a workpiece carrier plate 66 which forms, on the outside, a bearing surface 67 for the blanks 22, 49 (see FIG. 4, 5, 7). Two flaps 68, 69, 70, 71 are pivotably mounted in each case on the top and bottom edge of the workpiece carriers 14. The flaps 68 to 71 are brought by spring means 72, 73, 74, 75, such as leg springs, into the position in which they contact the bearing surface 67 of the workpiece carrier 14 with widenings 76, 77, 78, 79 at the end of their flap arms 80, 81, 82, 83.

The suction openings of the vacuum cups 62 to 65 are in the bearing surface 67 of the workpiece carrier 14.

The flap arms 80 to 83 with the widenings 76 to 79 at the ends serve to clamp and fold blanks 22, 49. On the other side of their pivot axes, the flaps 68 to 71 have contacting means 84, 85, 86, 87 in the form of cams on contact arms.

Furthermore, valve means 88 are arranged on the workpiece carriers. The valve means 88 are preferably preloaded by additional spring means into a closed position or open position. Furthermore, they are connected to additional contacting means so that they can be opened or closed by actuating the additional contacting means.

Figure 5:
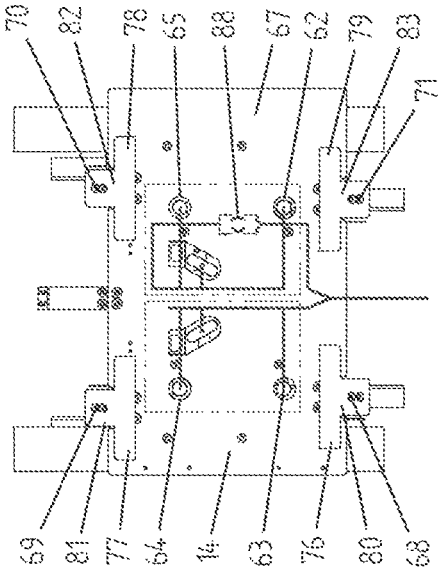
FIG. 5 shows a front view of the workpiece carrier.

Curves 89, 90, 92 are fixedly attached to the frame 15. The contacting means 84 to 87 and the additional contacting means are guided along the curves 89 to 92 such that they are actuated by them in order to swing the flaps 68 to 71 up to the position shown in FIGS. 4 and 5 and actuate the valve means 88.

A means for gluing 95 in the form of a nozzle is fixedly arranged on the processing line 93, 94.

The design of the machine 1 makes it possible to upright, or respectively fold and glue flat, pre-scored, or respectively stamped cardboard boxes. Both individual blanks as well as combinations of a plurality of blanks can be processed. The number of combinable blanks can be increased depending on the length of the processing line (sheen height).

In the following, the features and advantages of different exemplary embodiments of machines according to the invention will be explained.

The basic design of the machine makes it possible to upright and/or glue on a small footprint. The control and infeed side are opposite the product delivery to enable a combination consisting of a plurality of machines to increasing performance (depiction at the end of the description).

In contrast to conventional gluing machines, the machines function in a vertical direction, whereby the smaller necessary footprint is achieved.

The principle of the machine is based on entrained workpiece carriers which hold the products and on which all work steps are performed. Leaving the blank on the respective workpiece carrier ensures that great precision is achieved in the folding and gluing process since the product is not handed over to other transport systems. These processes are supported by folding elements which are arranged such that the products positioned on the workpiece carriers are folded while passing through in a hollow longitudinal direction. All transverse folds are carried out by means of the components on the workpiece carriers.

The cardboard boxes can be glued by various media. Cold glue and hot glue for uncoated cardboard boxes or hot-air for coated cardboard boxes are possible. Clamping or gluing with adhesive strips is also possible using corresponding additional aggregates.

The blanks are supplied to the workpiece carriers (the number fluctuates depending on the length of the vertical transport system) via an angle-adjustable storage magazine with separation and an intermediate conveyor belt.

The blanks are held on the workpiece carrier by a vacuum. The workpiece carriers are moved on a vertically running transport system. During transportation, devices are moved on the workpiece carrier by means of straight edges, or respectively curved segments and springs, in order to carry out folding and clamping. In addition, the formers and guides execute the longitudinal folds. At corresponding positions, additional blanks are transferred to the workpiece carriers which are glued to the first blank or folded into it. The fully processed blanks are delivered at the bottom end of the downward-running section of the transport system.

The cardboard blanks are placed as a stack in a storage magazine that is angled slightly relative to the transport system. This magazine is arranged in front of the machine such that the blanks can be separated while standing and supplied to a continuously circulating driver belt. This driver belt runs in sync with the cycling and speed of the transport system of the workpiece carrier. By means of bellows suction cups, the blanks are removed from the magazine which is provided with retainers and drawn toward the belt provided with drivers into the gap between two drivers. At the end position of the suction cup stroke, the vacuum switches off and thereby releases the blank for the drivers. The blank is then cut off from the suction cup against the existing residual vacuum.

Subsequently, the blank is guided by means of the driver belt around a sufficiently large wheel with an outer guide in order to then travel vertically upwards in the same direction of travel as the workpiece carrier transport system. Once the blank has traveled completely around the wheel, the blank which is now straight is guided against to the workpiece carrier on the transport system and suctioned there by the vacuum cups. After the belt travels briefly parallel to the transport system, the belt is guided away at a slight angle from the transport system before it is again guided toward the magazine around a pair of wheels.

Aligned by the drivers, the blank is now located on the workpiece carrier and held there by at least four vacuum cups. At this point in time, the grippers on the workpiece carrier needed for transverse folds lie against the workpiece carrier by means of spring force and thereby enable a nearly flat seating of the blank. Subsequently, the blank is provided with glue at specific points (hot and/or cold glue depending on the cardboard). Then the second blank supplied from a second magazine is placed on the first blank. Directly before this step, the grippers are lifted, and then form the counter holders for the transverse folding of the blank combination.

The second blank, i.e., the handle reinforcement, is also supplied to the machine while standing by means of a magazine at a slight angle relative to the machine. The blank is separated from the magazine by means of pivoting suction unit and placed on a table. By means of this table, the second blank is supplied to another pivoting suction unit which also holds the blank with suction cups.

This second pivoting suction unit is provided with a counterpressure plate with dimensions chosen so that it fits at a slight distance between the oriented grippers of the workpiece carrier. When the second blank is placed on the first one, this first blank is pushed through the grippers along the groove by the counterpressure plate and then folded at 90° perpendicular to the the direction of travel of the workpiece carrier (punch/die principle).

With the basket blank, the handle reinforcing tab is also pre-folded 90° by a spring-loaded abutment. Directly afterward, the counterpressure plate withdraws from the blank, and the grippers close under spring force. By means of this movement, the transverse fold from 90° to 80° is executed.

To ensure that the blanks on the workpiece carrier do not slip during the transverse folding process, the pivoting suction unit moves upward with the counterpressure plate in sync with the transport system until the counterpressure plate withdraws from the gripper area of the workpiece carrier. At this moment, the movement reverses from upward to downward, and the pivoting suction unit can receive the next blank. To prevent the transverse fold from springing back after the grippers open, the fold is then reinforced by the pressure of a roller applied against the workpiece carrier which rolls spring-loaded over the passing workpiece carrier.

Following the transverse folding, hot, or respectively and/or cold glue is applied to specific surfaces of the blank combination. The subsequent first longitudinal fold is performed by folding straight edges. To this end, one side of the grippers on the workpiece carrier open, and the vacuum is also switched off on one side. At this moment, the blank is lifted off the straight edge on the released side. Subsequently, the blank halves are always still elevated. At approximately 45°, the straightedge is supported by an entrained additional folder to prevent the blank from being compressed and shifted.

Before the workpiece carrier on the transport system runs around the top deflection of the transport system, the folding process is about 80% complete (about 160°) and is finished directly following the deflection. To this end, the two still-gripping grippers of the workpiece carrier are opened briefly in order to allow the blank to be swung in. After the blank surfaces are in contact and the grippers have closed again, they are immediately tightly bonded with each other by means of a press roller. Then hot, or respectively and/or cold glue is again applied in order to completely close the blank by means of another longitudinal fold. The side tab is placed on the blank from the rear by means of a folding straightedge and then passed through a pair of rollers in order to complete the fold and gluing.

The grippers on the workpiece carriers are actuated by means of springs and curve templates. The vacuum is applied to the workpiece carriers through a flat belt with connections which runs on a hollow profile open to the outside. The vacuum workpiece carrier is switched by means of mechanically-actuated vacuum valves in the workpiece carrier. By means of special material pairings, the heat arising from friction between the belt and hollow profile is kept to a tolerable level.

According to an additional embodiment, stop bars 91, or arbors, or other passive means for holding blanks are arranged on the workpiece carriers.

FIGS. 15.1-15.4 shows a combination of two machines according to the invention with a conveyor belt for folded and glued bottle carriers in a view from the right side (FIG. 15.1), a view from the front (FIG. 15.2), a top view (FIG. 15.3) and a perspective view from the front and from the right side (FIG. 15.4).

FIGS. 16.1-16.3 shows a combination of two machines according to the invention, each having an erector in a view from the left side (FIG. 16.1), in a top view (FIG. 16.2) and in a perspective view from the left side and from the rear (FIG. 16.3).

LIST OF REFERENCE NUMBERS

1 Machine
2 Transport system
3, 4 Bottom deflection rollers
5, 6 Top deflection rollers
7, 8 Tractive means
9, 10 Shafts
11 Drive
12 Electric motor
13 Gearbox
13.1 Additional gearbox
14 Workpiece carrier
15 Vertical frame
16 Additional frame
17, 18, 19, 20 Runs
21 Bottom magazine
22 Blanks
23 Vacuum system
24, 25 Vacuum cup
26 Supplying means
27 Additional transport system
28-33 Deflection rollers
34, 35 Tractive means
36, 37 Runs
38, 39 Additional runs

40, 41 Driver
48 Magazine
49 Blank
50 Pivoting suction unit
51 Delivery table
52 Carriage
53, 54 Vertical guides
55 Gearbox
55.1 Additional pivoting suction unit
56 Supplying means
57 Air channel
58 Opening
59 Endless belt
60 Holes
61 Lines
62-65 Vacuum cup
66 Workpiece carrier plate
67 Bearing surface
68-71 Flaps
72-75 Spring means
76-79 Widenings
80-83 Flap arms
84-87 Contact means
88 Valve means
89-92 Curves
93, 94 Processing line
95 Gluing means

The invention claimed is:

1. A machine for folding and adhesively bonding blanks for the production of folding boxes having:

A transport system (2) comprising at least one tractive means (7, 8) wrapped around deflection rollers (3 to 6) and running along a processing line, a drive (11) connected to at least one of the deflection rollers (3 to 6) and driving the at least one of the deflection rollers, workpiece carriers (14) that, at intervals from each other, are fastened to the at least one tractive means (7, 8), and are moved by the at least one tractive means (7, 8) along the processing line, at least one magazine (21, 48) for a stack of blanks (22, 49), at least one means for removing (23) individual blanks (22) from the stack in the magazine (21), at least one means for supplying (26) the removed blanks (22) to the workpiece carriers (14) in a movement synchronized with the workpiece carriers (14) along a part of the processing line, active means arranged on the workpiece carriers (14) for holding (68 to 71) blanks (22, 49) on the workpiece carriers (14), and active means arranged on the workpiece carriers (14) for folding (68 to 71) blanks (22, 49) arranged on the workpiece carriers (14), control means (84 to 87; 89 to 92) that are connected to the active means for holding (68 to 71) and the active means for folding (68 to 71), and control the holding and releasing of the blanks (22, 49) by the active means for holding (68 to 71), and the folding (68 to 71) of the blanks by the active means for folding (68 to 71), and at least one means arranged fixedly on the processing line for adhesively bonding (95) blanks (22, 49), and/or means arranged on the workpiece carriers (14) for adhesively bonding blanks.

2. The machine according to claim 1, wherein the control means (84 to 87; 89 to 92) are constructed and arranged to separately control each active means for holding (68 to 71) and/or each active means for folding (68 to 71) on each workpiece carrier (14).

3. The machine according to claim 1, wherein the active means for holding (68 to 71) are selected from the group consisting of: Vacuum cup, folding flap, or a combination of the vacuum cup and folding flap, and/or the active means for folding (68 to 71) are selected from the group consisting of: Folding flap, vacuum cup, or a combination of the vacuum cup and folding flap.

4. The machine according to claim 3, wherein the active means for holding are connected to means for supplying (56) a vacuum and/or compressed air from a fixedly arranged vacuum generator, to said workpiece carriers movable along the processing line (93, 94).

5. The machine according to claim 4, wherein the means for supplying (56) a vacuum have a fixed air channel (57) running parallel to the processing line and connected to the vacuum generator and which, on one side, has an opening (58) that extends along the processing line and is sealingly covered by a parallel belt (59) which runs around at least one tractive means and has holes (60) next to the workpiece carriers (14) which are connected via lines (61) to the vacuum cups (63 to 66) on the workpiece carriers.

6. The machine according to claim 4, wherein valve means (88) are arranged on the workpiece carriers (14) by means of which the vacuum cups (63 to 66) are connected to the means for supplying a vacuum.

7. The machine according to claim 1, wherein the active means for holding (68 to 71), and/or the active means for folding (68 to 71), comprise flaps arranged on the workpiece carriers (14) for clamping and/or folding sections of the blanks.

8. The machine according to claim 7, wherein means for pivoting the flaps comprise spring means (72 to 75) which pretension the flaps in a starting position.

9. The machine according to claim 1, wherein the control means (89 to 92) have stationary curves, and the active means for holding (68 to 71), and/or active means for folding (68 to 71) are coupled to contacting means (84 to 87) for contacting the curves.

10. The machine according to claim 1, having passive means arranged on the workpiece carriers (14) for holding blanks (22, 49) on the workpiece carriers (14), and/or at least one passive means fixedly arranged on the processing line for folding blanks (22, 49) on the workpiece carriers (14).

11. The machine according to claim 10, wherein the passive means for holding are stop bars arranged on the workpiece carriers (14).

12. The machine according to claim 1, wherein the active means arranged on the workpiece carriers (14) for folding (68 to 71) the blanks (22, 49) along a fold line in a direction perpendicular to the direction of transport, and/or a passive means fixedly arranged on the processing line for folding blanks (22, 49) along a fold line in the direction of transport of the workpiece carriers (14).

13. The machine according to claim 1, wherein the runs (17 to 20) of the at least one tractive means (7, 8) are oriented vertically.

14. The machine according to claim 13, which has an elongated, vertical frame (15).

15. The machine according to claim 1, being housed in a frame (15, 16).

16. The machine according to claim 1, wherein the at least one magazine (21) and the means for supplying individual blanks (26) are arranged on the side of a first run of the tractive means (7, 8), and wherein a delivery station for delivering folded and adhesively bonding blanks (22, 49) is arranged on the side of a second run of the tractive means (7,8).

17. The machine according to claim 1, wherein the means for removing (23) individual blanks from the stack in the magazine (21) comprise a vacuum system (24, 25) which sections an individual blank (22) from a stack in the magazine into a transfer position, and wherein the means for supplying (26) the removed blanks (22, 49) to the workpiece carriers (14) comprise an additional transport system (27) with at least one tractive additional tractive means (34, 35) running around an additional deflection roller (28 to 33), wherein another run (36, 37) of the additional tractive means runs by the transfer position, and another run (38, 39) of the additional tractive means (34, 35) runs along a section of a transfer line (93), drivers (40, 41) are arranged on the additional tractive means, the additional transport system (27) has an additional drive (13.1, 12), the vacuum system (24, 25) and the additional drive are connected to the control means such that the vacuum system (24, 25) is synchronized with the additional drive, and the additional drive is synchronized with the drive such that the vacuum system (24, 25) always positions an individual blank (22) from the magazine (21) in the transfer position between the drivers (40, 41) on the additional tractive means (34, 35), the at least one additional tractive means (34, 35) entrains the blank (22) held between the drivers (40, 41), and the blank (22) is supplied to the workpiece carrier (14) via one of the runs (38, 39) extending substantially in the direction of a section of the processing line (94).

18. The machine according to claim 1, including means for supplying half a supply plate on which each blank (49) can be positioned, wherein the means for supplying have means for transferring the supply plate (49) at a right angle to the run of the transport system (2) by a drive that is connected to the control means, and the control means control the transfer of the supply plate at a right angle toward the workpiece carrier (14) in a last section of supplying each blank (49) to one of the workpiece carriers (14).

19. The machine according to claim 18, wherein the supply plate is dimensioned such that, when moving at a right angle toward the workpiece carrier (14), the supply plate can move between support means (68 to 71) on the workpiece carrier (14) on which a blank (22) can be placed.

20. The machine according to claim 1, wherein the means for removing individual blanks (49) from the stack in the magazine (48) comprises a pivoting suction unit (50) that always places an individual blank (49) on a delivery table (51), and the means for supplying the removed blank to one of the workpiece carriers (14) comprises a carriage (52) which is guided in guides (53, 54) along a section of the processing line (94), and on which an additional pivoting suction unit (55.1) is arranged to receive an individual blank (49) from the delivery table (51) when the carriage (52) is arranged in a bottom position and, after a pivoting movement, to supply the blank (49) to a workpiece carrier (14) in a top position of the carriage (52), wherein the carriage (52) is connected to another drive, the pivoting suction unit (50) is connected to an additional drive, and the additional pivoting suction unit (55.1) is connected to an additional drive, and the additional drives are connected to the control means such that, after a blank (49) is placed on the delivery table (51) by the pivoting suction unit (50), the additional pivoting suction unit (55.1) receives the blank (49), and the carriage (52) executes a synchronized movement with one of the workpiece carriers (14), and the additional pivoting suction unit thereby supplies the blank (49) to the workpiece carrier (14).

21. The machine according to claim 18, wherein the additional pivoting suction unit (55.1) comprises means for transferring the blank (49) at a right angle toward the workpiece carrier (14) by an additional drive that is connected to the control means.

22. The machine according to claim 1, constructed and arranged so that the active means for holding (68 to 71) on the workpiece carriers (14) take the blanks (22, 49) from the at least one means for supplying (26, 56).

23. An arrangement of at least one machine (1) according to claim 1 for combining folded and adhesively bonded blanks into transport units, or for filling folded, adhesively bonded blanks with goods.

24. A method for folding and adhesively bonding blanks for the production of folding boxes, wherein:

The blanks are held on workpiece carriers by active means for holding blanks, and are transported on the workpiece carriers along a processing line, and are folded by an active means for folding while being transported along the processing line, and while being transported along the processing line, the blanks are adhesively bonded by at least one means for adhesively bonding blanks fixedly arranged on the processing line, and/or are adhesively bond by means for adhesively bonding blanks transported on the workpiece carriers along the processing line.

25. The method according to claim 24, wherein the blanks are withdrawn from at least one stack fixedly arranged next to the processing line and supplied to the workpiece carriers.

26. The method according to claim 25, wherein the active means for holding hold the blanks by means of a vacuum, or by clamping, and/or the active means for folding fold the blanks by means of folding flaps, or a vacuum.

27. The method according to claim 26, wherein the vacuum is supplied to the active means for holding, and/or the active means for folding, on the workpiece carriers, by a stationary vacuum generator while transporting along the processing line.

28. The method according to claim 25, wherein the active means for holding, and/or the active means for folding, are controlled by contacting stationary curves.

29. The method according to claim 25, wherein the blanks, while being transported along the processing line, are held on the workpiece carriers by passive means for holding transported on the workpiece carriers along the processing line, and/or are folded by at least one passive means for folding fixedly arranged on the processing line.

30. The method according to claim 25, wherein the active means for folding which are transported along the processing line fold the blanks while being transported along the processing line along fold lines in a direction perpendicular to a direction of transport, and/or passive means for folding which are fixedly arranged on the processing line fold the blanks along fold lines in the direction of transport.

31. The method according to claim 25, wherein, after a fold on a fold line, the blanks are further processed along the fold line by means of a pressure roller that rolls on the blanks and is stationarily arranged on the processing line.

32. The method according to claim 25, wherein the blanks are transported, folded and adhesively bonding along a vertically oriented processing line.

33. The method according to claim 25, wherein the blanks are first transported upward and then downward after being supplied to the processing line, and are removed from the processing line while being transported downward.

34. The method according to claim 25, wherein the blanks are removed from a magazine by suction and supplied to the processing line.

35. The method according to claim 25, wherein the blanks are uprighted, filled and closed after the processing line.

36. The method according to claim 25, wherein the blanks are stacked in a flat state after the processing line.

37. The method according to claim 25, wherein the blanks are temporarily stored after the processing line or are uprighted, filled and closed directly afterward.

38. The method according to claim 24, wherein each active means for holding, and/or each active means for folding, are controlled separately.

39. A method for folding and adhesively bonding blanks for the production of folding boxes, wherein:

the blanks are held on workpiece carriers by active means for holding blanks, and are transported on the workpiece carriers along a processing line, and are folded by an active means for folding while being transported along the processing line;

while being transported along the processing line, the blanks are adhesively bonded by at least one means for adhesively bonding blanks fixedly arranged on the processing line, and/or are adhesively bond by means for adhesively bonding blanks transported on the workpiece carriers along the processing line;

wherein the blanks are withdrawn from at least one stack fixedly arranged next to the processing line and supplied to the workpiece carriers, and further wherein the blanks are rotated 90° while being transported along the processing line and are folded by means for folding arranged along the processing line on fold lines offset from each other by 90°.

* * * * *